US008307623B2

(12) United States Patent
Konukoglu et al.

(10) Patent No.: US 8,307,623 B2
(45) Date of Patent: Nov. 13, 2012

(54) AUTOMATIC RING (YARN MACHINE) SPINDLE STOPPER

(75) Inventors: Hakan Konukoglu, Gazientep (TR); Ahmet Gokhan Aydin, Gazientep (TR)

(73) Assignee: Sanko Tekstil Isletmeleri San. Ve Tic. A.S., Gaziantep (TR)

( * ) Notice: Subject to any disclaimer, the term of this patent is extended or adjusted under 35 U.S.C. 154(b) by 0 days.

(21) Appl. No.: 13/170,982

(22) Filed: Jun. 28, 2011

(65) Prior Publication Data

US 2012/0018563 A1 Jan. 26, 2012

Related U.S. Application Data

(63) Continuation-in-part of application No. 12/067,469, filed as application No. PCT/TR2006/000011 on Apr. 3, 2006, now abandoned.

(30) Foreign Application Priority Data

Sep. 21, 2005 (TR) ..... 2005/03780

(51) Int. Cl.
*D01H 13/00* (2006.01)

(52) U.S. Cl. ..... 57/88

(58) Field of Classification Search ..... 57/75, 88
See application file for complete search history.

(56) References Cited

U.S. PATENT DOCUMENTS 4,023,342 A * 5/1977 Schenkel ..... 57/264
5,009,063 A * 4/1991 Yamaguchi et al. ..... 57/124
5,396,757 A * 3/1995 Kobayashi et al. ..... 57/100
5,740,666 A * 4/1998 Yamaguchi et al. ..... 57/264
5,755,085 A * 5/1998 Insley ..... 57/88
6,298,648 B1 * 10/2001 D'Agnolo ..... 57/58.49

* cited by examiner

*Primary Examiner* — Shaun R Hurley
(74) *Attorney, Agent, or Firm* — Collen IP; Donald J. Ranft

(57) ABSTRACT

A spindle stopping mechanism for a yarn machine including a magnetic field assembly which when energized by a signal from a yarn breakage sensor causes a spindle gripping mechanism to grip and stop a spindle. A locking mechanism is also provided.

9 Claims, 8 Drawing Sheets

AUTOMATIC RING (YARN MACHINE) SPINDLE STOPPER

CROSS REFERENCE

This application is a Continuation in Part of U.S. patent application Ser. No. 12/067,469 filed Aug. 11, 2008 which is fully incorporated by reference into this application.

RELATED FIELD OF THE INVENTION

This invention is related to ring type yarn machines and means to stop spindle upon yarn breakage.

In current ring type yarn machines, yarn is produced by winding yarn on a cop that is on a revolving spindle. The spindle revolves as it is driven by a main motor via belts. In case of a yarn breakage due to any reason, the spindle continues revolving. Meanwhile, no yarn is produced. Since there is no signal or system in order to notify any breakage, the spindle revolves idly until the operator notices the breakage while walking about the machine. With the breakage of the yarn (during the idle spinning of the spindle);

- yarn to be produced goes to waste by flowing into a pneumatic duct. Meanwhile, until the operator joins the yarn by twisting, the spindle revolves without any yarn production.
- since the spindle continues spinning, the free end of the yarn wound on the cop generates fly by rubbing against some parts of the machine. These cotton flies are loss of production and cause yarn breakages on the same machine or on the other machines in the same room. Thus yarn breakage on a machine causes more than one breakage, which increases the total number of breakages on the machine. In order to act quickly against the increased number of breakages the number of operators working on the machines should be increased, for the number of operators are determined according to the standard number of the breakages.
- when the number of breakages exceed the standards, the production speed of machines are decreased at the expense of production loss in order to run the enterprise efficiently or the problem is resolved by increasing the number of operators via working them overtime so as to decrease the number of machines per worker.
- in order to retie a broken spindle operators stop the spindles by lifting or lowering spindle brakes by their knees or hands manually depending on the type of the machine, perform required actions, restart the spindle by releasing the brake and finally perform tying.

The primary advantages provided by developing an automatic spindle stopper for a yarn machine are:

- to stop the spinning spindle immediately, in case of a yarn breakage,
- to prevent other yarn breakages caused by flies generated by a broken yarn,
- to run the yarn machine faster,
- to decrease the number of operators per machine,
- to increase the efficiency (by increasing production),
- to reduce costs.

PART NUMBER LIST

Figure 1:
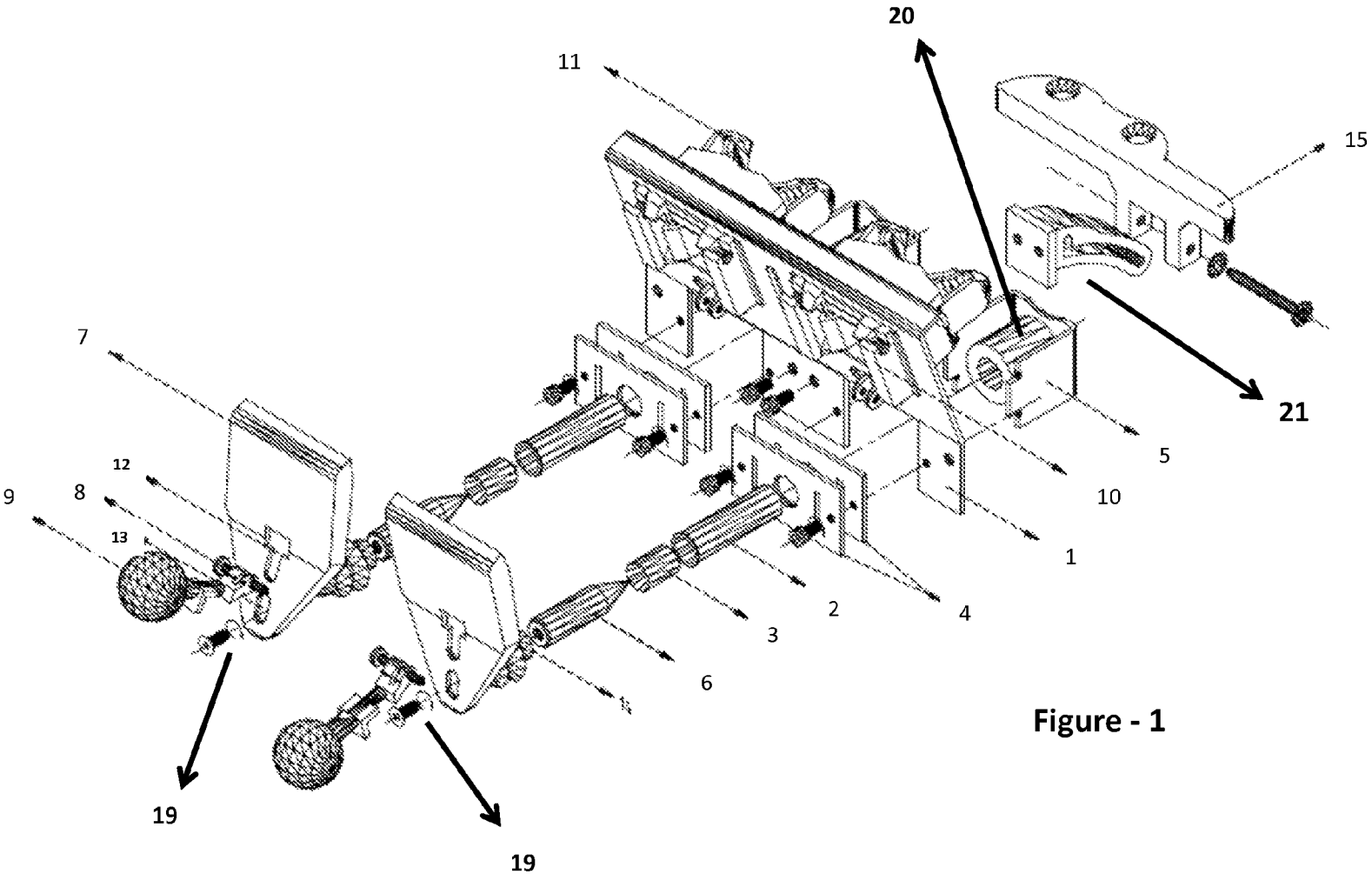
FIG. 1—General exploded view of the spindle stopper mechanism
Figure 2:
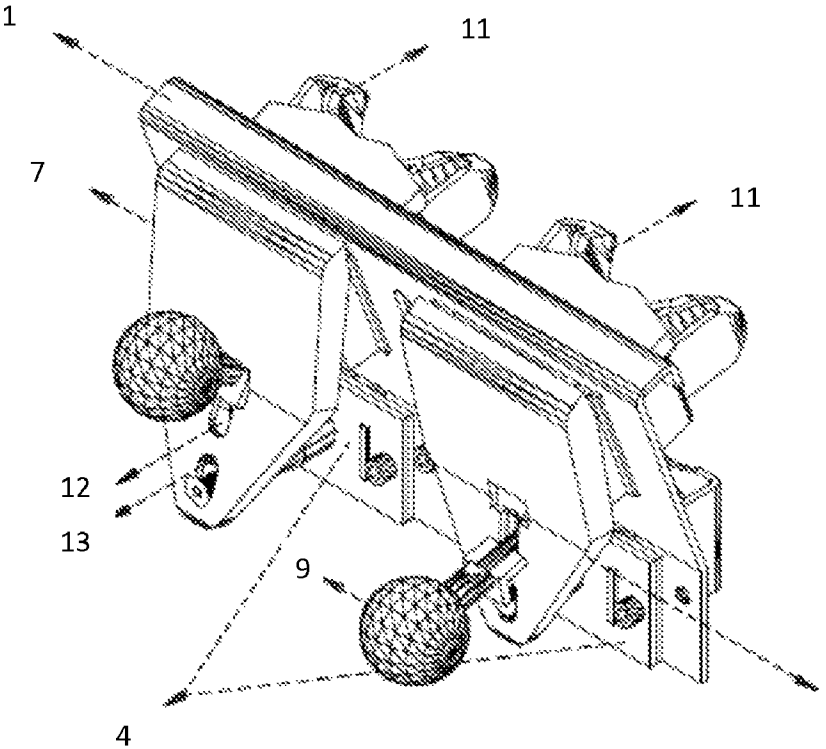
FIG. 2—View of the spindle stopper ready to be mounted on ring (yarn) machine FIG. 3—General exploded view of some parts of the spindle stopper mechanism (without stopping arm rear mounting section-clamps)
Figure 3:
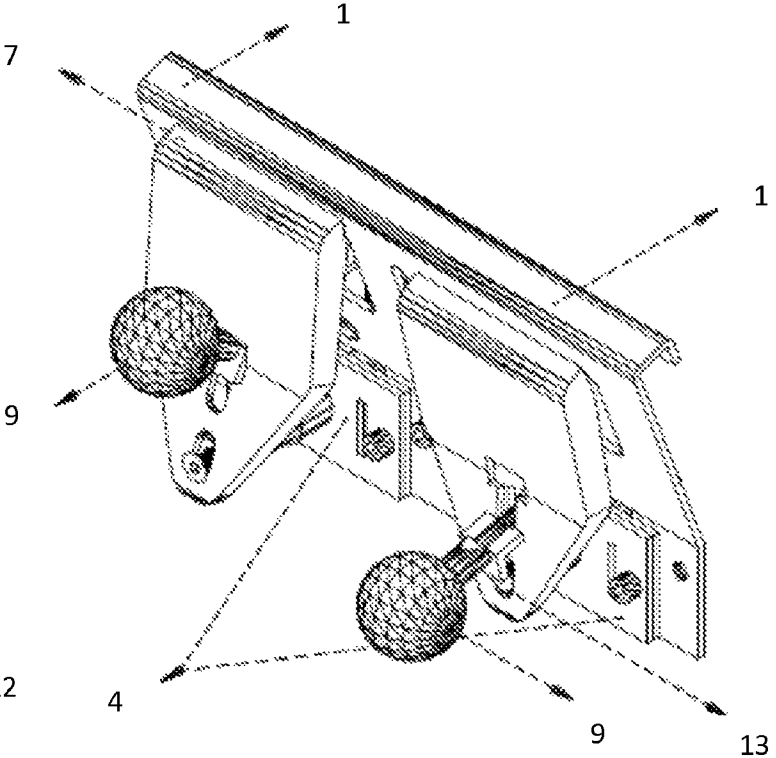
Figure 5:
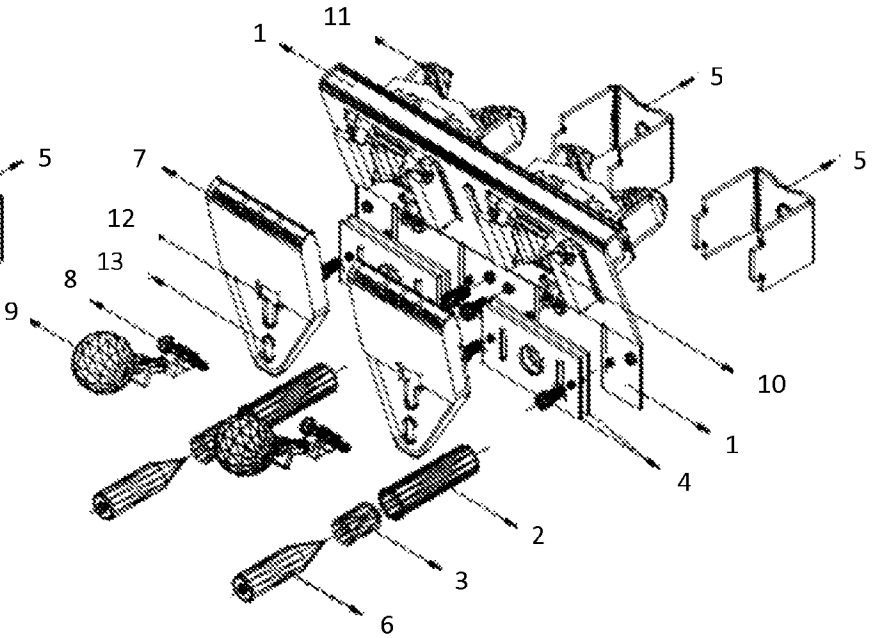
FIG. 5—Disassembled view of the parts of the spindle with clamps added
Figure 4:
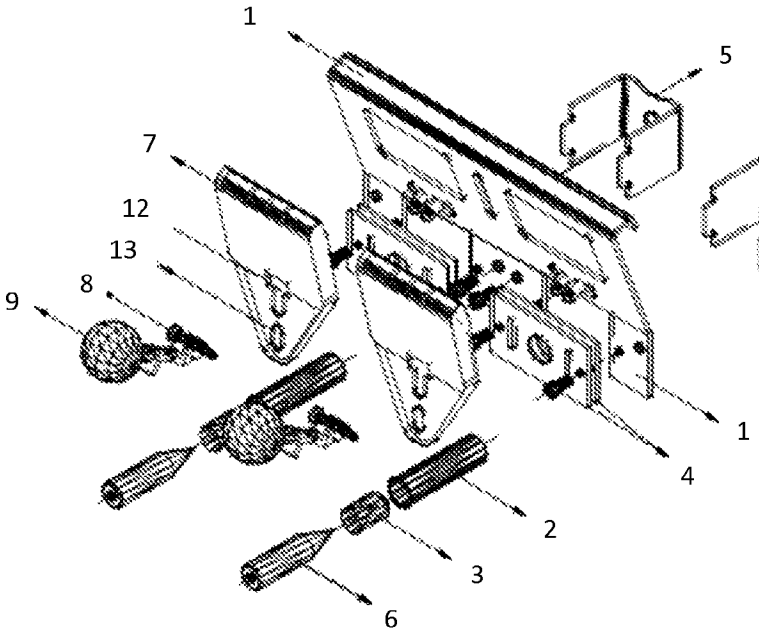
FIG. 4—Disassembled view of the spindle stopper
Figure 7:
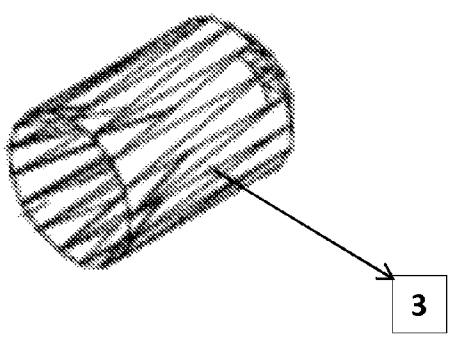
Figure 9:
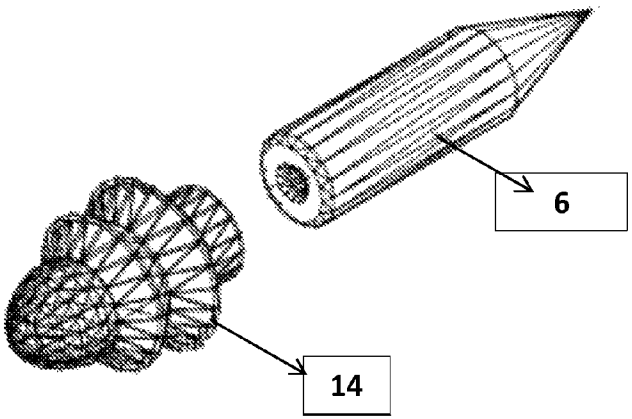
Figure 6:
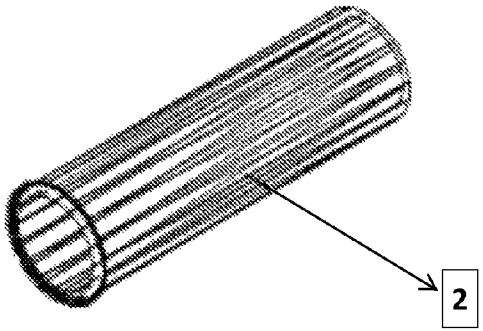
FIG. 6—Perspective view of the metal cylinder around which coils are wound to allow the creation of a magnetic field FIG. 7—Perspective view of the coil housing FIG. 8—Perspective view of the front cover of the box which houses the magnetic field coil and coil housing FIG. 9—Perspective view of the metal insertion piece and its cap which move forward and backward in the magnetic field FIG. 10—Perspective view of the rear part of box which houses the magnetic field coil and coil housing FIG. 11—Perspective view of the stopping arm that applies pressure on the brake in order to actuate the spindle stopper FIG. 12—Perspective view of the locking arm and metal weight that locks the brake FIG. 13—Perspective view of the mounting piece and connection piece FIG. 14—Perspective view of the spindle stop mechanism in relation to spindle (shown as active and inactive position with certain parts omitted to avoid blocking view of critical parts)
Figure 8:
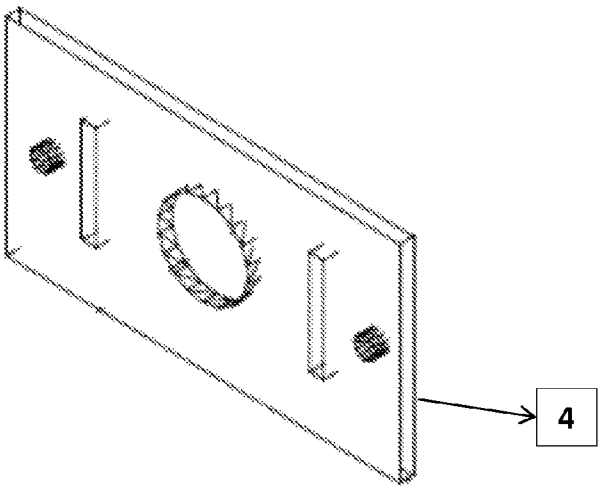
Figure 11:
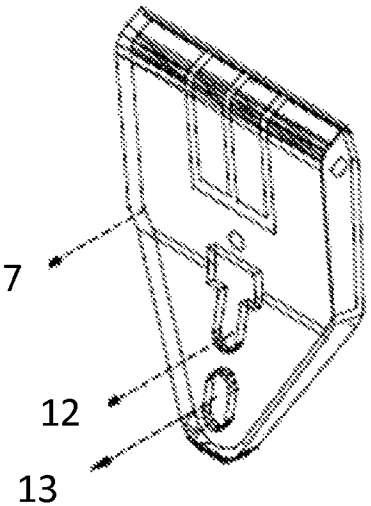
Figure 13:
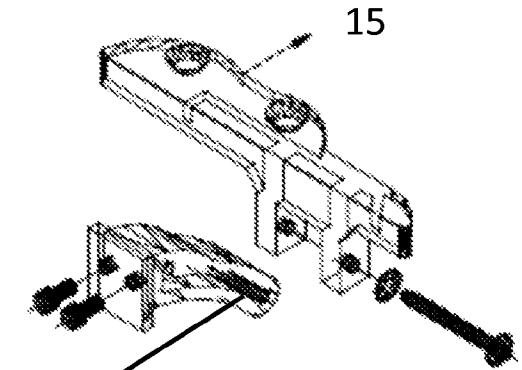
Figure 10:
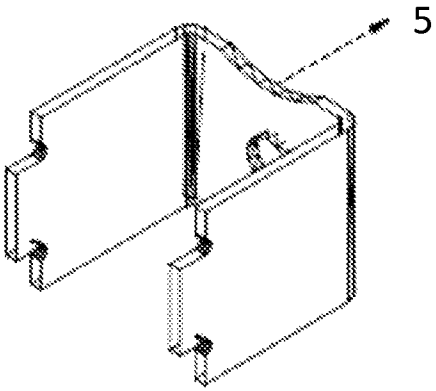
Figure 12:
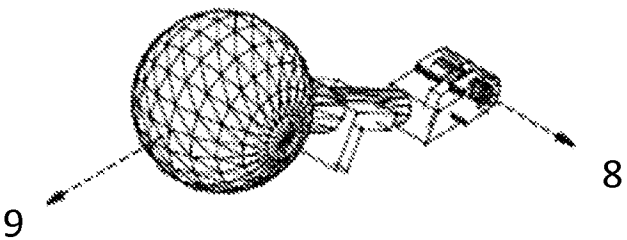

In order to provide a better explanation of the spindle stopper the parts are numbered as follows:

1—Main mounting piece
2—Magnetic field coil piece (without coiled wired)
3—Coil housing
4—Front cover of magnetic field coil box
5—Magnetic field coil box
6—Metal insertion piece
7—Stopping arm
8—Locking arm piece
9—Weight
10—Stopping arm mounting piece
11—Spindle clamp
12—Stopping arm "T"-shaped slot
13—Stopping arm "I" shaped slot
14—Metal insertion piece cap
15—Spindle stopper mounting piece
16—Breakage sensors
17—Spindle ring
18—Traveller
19—Screw
20—Magnetic field coil piece (with coiled wired)
21—Connection piece
22—Protrusion piece

DETAILED DESCRIPTION

The spindle stopping mechanism provides a means to detect and stop a spindle upon detection of yarn breakage. The primary mechanisms comprising one embodiment are:

- magnetic field coil assembly
- spindle gripping mechanism
- locking mechanism
- breakage sensor The magnetic field coil assembly (FIGS. 1, 6, 7, 8, 9, & 10) includes the magnetic field coil piece (2), coil housing (3), front cover (4), magnetic field box (5), metal insertion piece (6). The metal insertion piece (6) has a plastic cap (14) on top to provide protection against dust. In order to generate the magnetic field, wire is wound around the exterior surface of the magnetic field coil piece (2). When energized the magnetic field coil (20) pulls metal insertion piece (6) into the coil housing (3) by generating a magnetic field. The magnetic field coil (2) is energized by the breakage sensor (16) when the yarn is broken.

Figure 16:
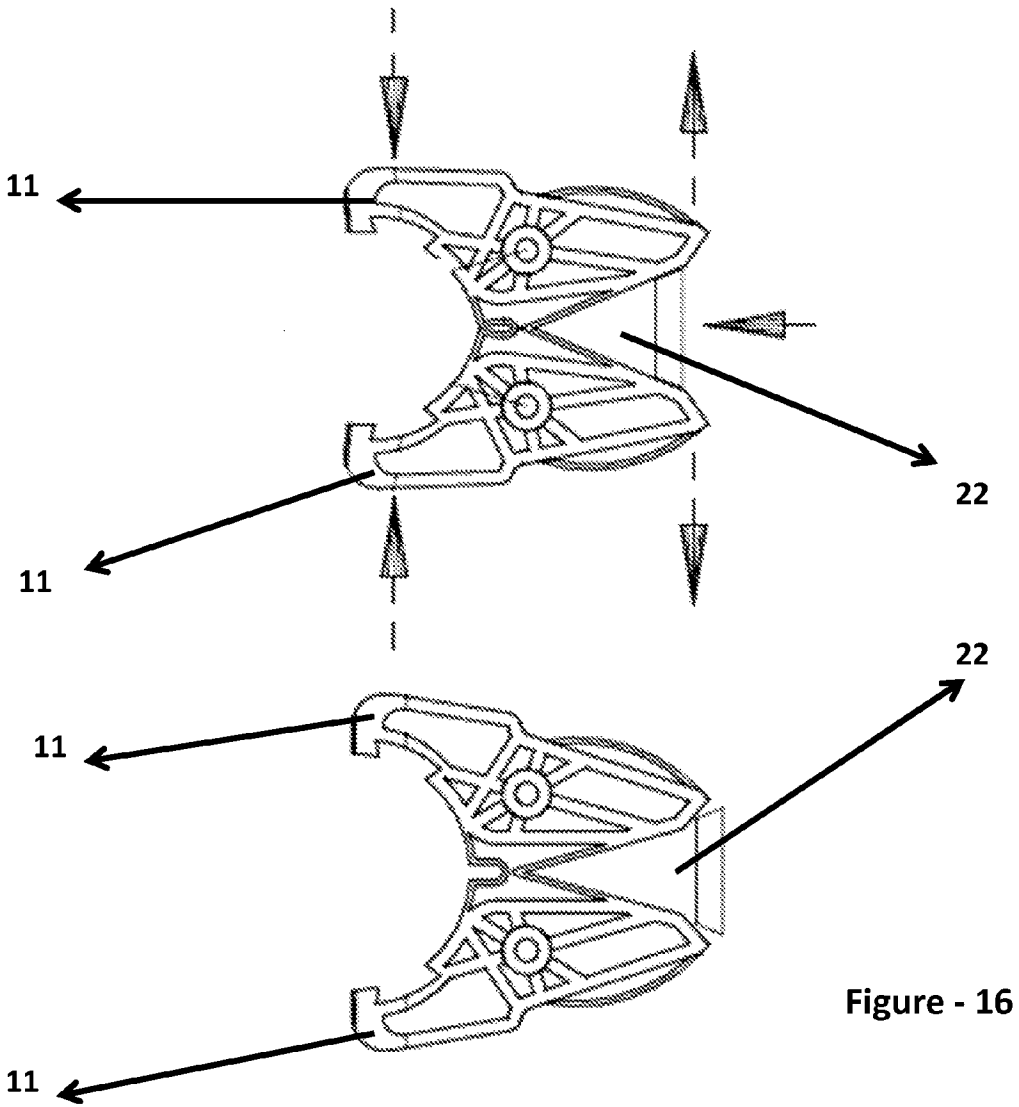
FIG. 16—Top view of clamps and protrusion pieces

A spindle gripping mechanism is provided to grip and stop a spindle when the magnetic field coil assembly is activated. A screw (19) inserted through an "I" shaped slot (13) on the stopping arm (7) attaches the magnetic field coil piece (2) and its cap (14) to the stopping arm (7) which is mounted on the main mounting piece (1) using the stopping arm mounting piece (10). The front cover (4) of the magnetic field coil assembly is attached to the main mounting piece (1). Clamps (11) are attached to the rear of the main mounting piece (1). When a magnetic field is generated to stop the spindle, the metal insertion piece (6) is pulled by the magnetic field causing corresponding movement of the stopping arm (7). A protrusion piece (22—on FIG. 16) which is typically plastic, is attached on the rear of the stopping arm (7). Movement of the stopping arm (7) causes the movement of the protrusion piece (22) into the spindle clamp (11) which causes the clamp to grab and stop the spindle.

Figure 14:
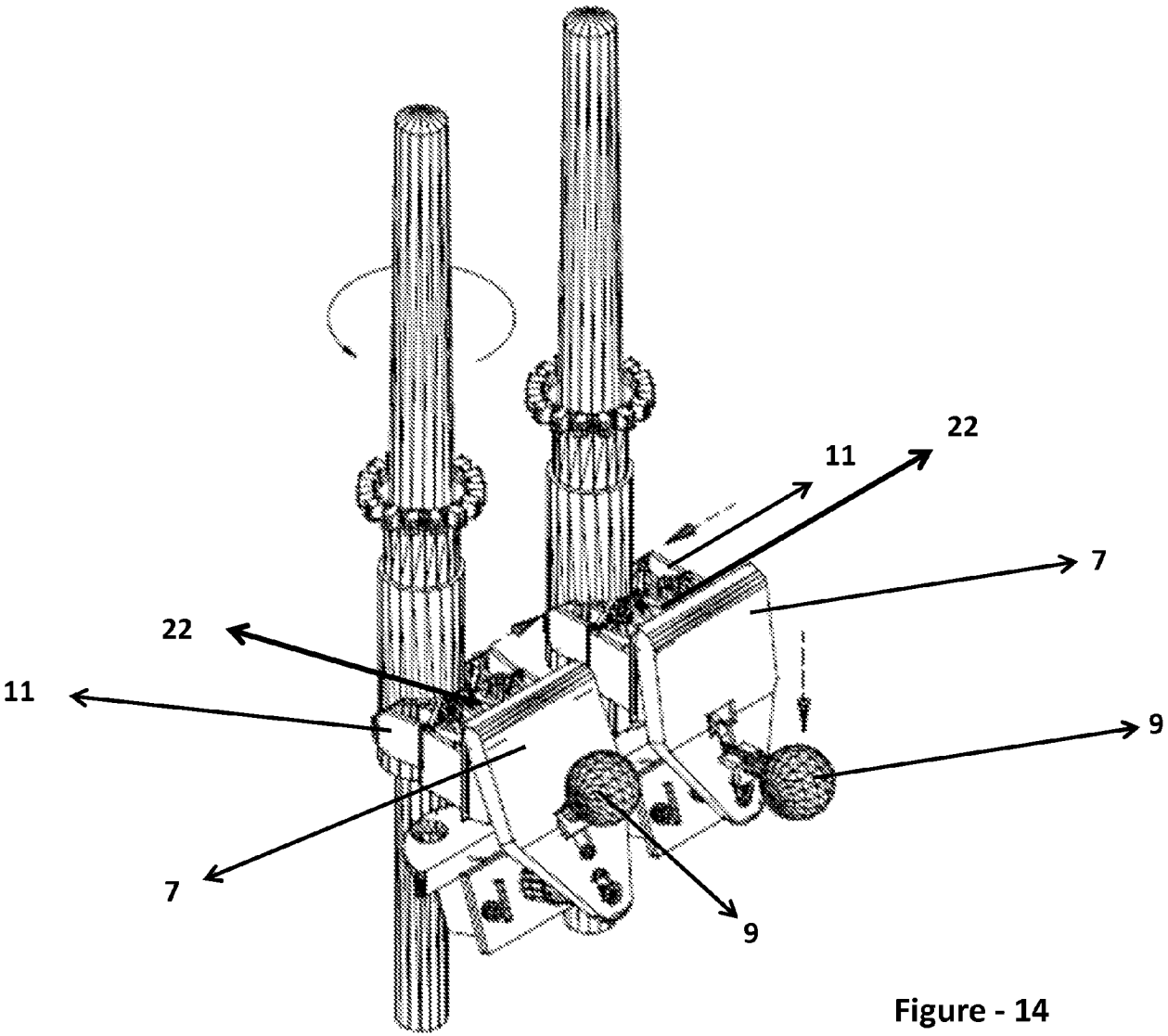
Figure 15:
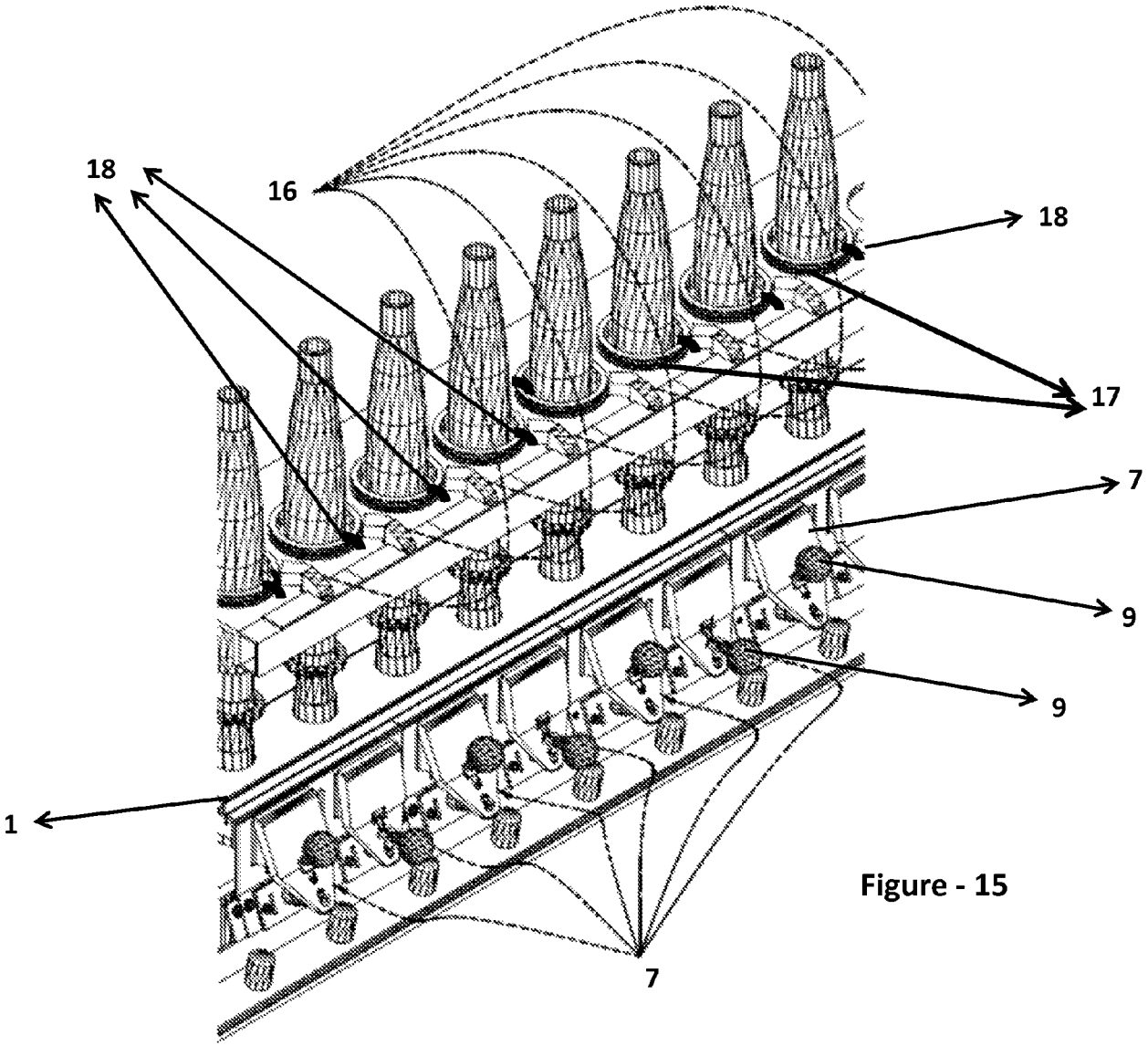
FIG. 15—Partial view of the yarn machine showing the breakage sensors and spindle stoppers.

FIG. 14 shows 2 spindles with the spindle stopping device mounted on each. The right assembly on FIG. 14 shows the stopping device not actuated with the spindle spinning and the left assembly on FIG. 14 shows the device actuated with the spindle stopped.

A locking mechanism is provided to lock the gripping mechanism in place when activated until manually reset. Movement of the stopping arm (7) allows the typically metal weight (9) to pull the locking arm (8) piece down the "T" shaped slot (12) on the stopping arm (7). This manually locks the stopping arm in place until reset.

The main mounting piece (1) is a typically metal component that is used to mount the spindle stopper for a yarn machine developed with the present invention to a ring machine. The aforementioned parts are assembled on the main mounting piece (1) (FIGS. 1, 2, 3, 4 and 5). After being assembled, said parts are mounted to the ring machine via a mounting member (15) and its connection piece (21).

The spindle stopper mounting member (15) is a typically plastic piece with slots and bolt holes to which the spindle stopper mechanism is mounted to the machine.

The breakage sensor (16), detect breakages in yarn on the spindles in the machine by following the travellers (18) on the spindle ring (17. When a breakage is sensed a signal causes the magnetic field to energize. There is at least one yarn breakage sensor (16) for each spindle on a yarn machine.

With this information, the main head sends energy from its own electronic component to the coiled piece (2). Meanwhile, a magnetic field is generated in the magnetic field coil (2) and the metal insertion piece (6) is pulled to the centre of magnetic field by the magnetization effect of the magnetic field. The coil housing (3) functions as a guide ensuring that the proper movement. After being stopped by the spindle stopper, the energy of the system is cut off and the brake is locked via the mechanical locking mechanism described above. The operator prepares the yarn system of this spindle and releases the metal weight (9) manually in order to restart the yarn spinning process. In this case, the brake mechanism returns to its initial position, since there is no magnetic field in the system.

The primary aspects of how this device works is as follows:

When the yarn brakes (snaps), this breakage is detected by the sensors (16) located at the top. The sensors (16) follow the travellers (18) on the ring (17), normally the travellers (18) turns on the ring with a very high speed. The traveler (18) is turned by the spinning yarn. If the yarn breaks then the speed of the travellers decreases sharply. The sensor (16) detects the yarn breakage on this spindle. There are separate sensors (16) and locking mechanism for each spindle. The main aim is to stop only the spindle which the yarn is broken.

After the sensors (16) detect the breakage, an electric current passes through the magnetic field coil (2) of the automatic spindle. This electric current charges the magnetic field coil (2) of the automatic spindle stopper and pulls the metal insertion piece (6) to itself. Since the metal insertion piece (6) is assembled to the underside of the stopping arm (7), the pitch forward of the metal insertion piece (6) also moves the stopping arm (7) forwards. The pitch forward of the stopping arm (7) moves the clamps (11) axially making the clamps (11) to act like a gripper. By this movement, the activated clamp (11) grabs and holds the spindle like a hand claw (gripper) and brakes the spindle. Meanwhile, the weight (9) moves downwards and locks the automatic spindle stopper.

After the broken yarn is tied by the workers, the weight (9) is relocated to the "up" position manually and that sets the spindle break free which allows the spindle to start spinning Although several embodiments described above and by the claims serve to illustrate various concepts, components and techniques which are the subject of this patent, it is apparent to those of ordinary skill in the art that other embodiments incorporating these concepts, components and techniques may be used. It is understood that the scope of the following claims are not limited to the described embodiments and that many modifications and embodiments are intended to be included within the scope of the following claims. In addition the specific terms utilized in the disclosure and claims are used in a generic and descriptive sense and not for the purpose of limiting the invention described in the following claims.

The invention claimed is:

1. A spindle stopping mechanism comprising:
a magnetic field coil assembly;
a spindle gripping mechanism;
a locking mechanism; and
a yarn breakage sensor.

2. A spindle stopping mechanism according to claim 1 in which the spindle gripping mechanism is activated when the yarn breakage sensor signals the magnetic field coil assembly to be energized.

3. A spindle stopping mechanism according to claim 2 wherein the locking mechanism locks the spindle gripping mechanism in place when it is activated and requires manually resetting to release a spindle from the spindle gripper mechanism.

4. A spindle stopping mechanism according to claim 1 wherein the magnetic field coil assembly comprises:
magnetic field coil piece;
coil housing;
metal insertion piece; and
magnetic field coil box.

5. A spindle stopping mechanism according to claim 4 wherein the metal insertion piece includes a cap.

6. A spindle stopping mechanism according to claim 4 in which the spindle gripping mechanism comprises:

a stopping arm to which the magnetic field assembly is attached;

a protrusion piece attached to the stopping arm;

a main mounting piece to which the stopping arm is attached; and a clamp attached to the main mounting piece.

7. A spindle stopping mechanism according to claim 6 wherein the locking mechanism comprises: a locking arm piece protruding through a "T" shaped slot on the stopping arm with a weight on an end of the locking arm.

8. A spindle stopping mechanism according to claim 6 wherein the breakage sensor follows a traveller on a ring around the spindle and upon sensing a speed decrease of the traveller causes energization of the magnetic coil pulling the metal insertion piece to itself, and since the metal insertion piece is attached to the stopping arm, the pitch forward of the metal insertion piece also moves the stopping arm forwards, causing the insertion of the protrusion piece into the clamp and the gripping of the spindle by the clamp.

9. A spindle stopping mechanism according to claim 6 wherein the main mounting plate is attached to a mounting member on the yarn machine.

* * * * *